US006431493B1

(12) United States Patent
Stauner

(10) Patent No.: US 6,431,493 B1
(45) Date of Patent: Aug. 13, 2002

(54) TISSUE ROLL HOLDER RELEASE DISC

(76) Inventor: Norbert C. Stauner, 18 Placer Loop, Basin, MT (US) 59631

( * ) Notice: Subject to any disclaimer, the term of this patent is extended or adjusted under 35 U.S.C. 154(b) by 0 days.

(21) Appl. No.: 10/029,269

(22) Filed: Dec. 28, 2001

(51) Int. Cl.[7] ..... B65H 75/18
(52) U.S. Cl. ..... 242/598.3
(58) Field of Search ..... 242/598.3, 598.6, 242/599.1, 599.3

(56) References Cited

U.S. PATENT DOCUMENTS

| | | | | | |
|---|---|---|---|---|---|
| 1,045,311 | A | | 11/1912 | Moberg | |
| 1,203,588 | A | * | 11/1916 | Currie | 242/598.3 |
| 1,557,700 | A | * | 10/1925 | Jaderlund | 242/598.3 |
| 2,171,648 | A | | 9/1939 | Ennis et al. | |
| 2,253,664 | A | | 8/1941 | Vigo | |
| 2,313,776 | A | | 3/1943 | Segal | |
| 2,434,556 | A | * | 1/1948 | Foltis | 242/598.3 |
| 2,522,109 | A | | 9/1950 | Foltis | |
| 2,801,809 | A | * | 8/1957 | Glaner | 242/599.3 |
| 2,889,122 | A | | 6/1959 | McConnell | |
| 3,034,739 | A | * | 5/1962 | Barger | 242/599.3 |
| 3,037,718 | A | | 6/1962 | Petit | |
| 3,239,158 | A | | 3/1966 | Levesque | |
| 3,362,653 | A | | 1/1968 | Carlisle | |
| 3,392,928 | A | | 7/1968 | Peterson | |
| 3,633,838 | A | | 1/1972 | Krueger | |
| 4,383,656 | A | | 5/1983 | Campbell | |

* cited by examiner

*Primary Examiner*—William A. Rivera
(74) *Attorney, Agent, or Firm*—C. J. Husar, Esq.

(57) ABSTRACT

A release disc that is mounted on one end of a tissue roll holder and provides an easy, less stressful way of releasing a tissue roll holder after the tissue roll has been depleted and it is now time to install a fresh roll of tissue. The release disc is placed over either end of the roll holder on the reduced diameter portion prior to inserting the roll holder by placing one's fingers over the release disc to compress the roll holder sufficiently to clear the mounting support and insert it into the support recesses. The procedure is merely reversed for removal of the roll holder when it is time to add a new roll of tissue to the roll holder. The invention finds particular usefulness with persons of impaired dexterity or other infirmities. The release disc is installed without any required tools or modifications to the current roll holder assembly.

8 Claims, 1 Drawing Sheet

TISSUE ROLL HOLDER RELEASE DISC

BACKGROUND OF THE INVENTION

The present invention relates to a tissue roll holder attachment and more specifically, to an attachment for a tissue roll holder that facilitates the removal of the roll holder from its socket in the mounting frame after the roll of tissue has been expended and in preparation for the installation of a fresh roll of tissue thereon.

We have all, at one time or another, experienced the difficulty of releasing the tissue roll holder from the mounting bracket that receives opposite ends of the roll holder in the recesses provided therein. This experience can be challenging for a person of normal dexterity, however, it becomes ever more challenging and stressful for members of our aging population with their various illnesses such as arthritic conditions, poor eyesight, back problems and various other disabilities. Recognizing this problem, applicant has endeavored to devise a simple, inexpensive attachment which is readily accommodated by any conventional tissue roll holder found in millions of homes throughout the country and is easily attached without the need for any special tools or modification to the standard tissue roll holder.

DESCRIPTION OF THE PRIOR ART

A manual pre-examination search in the appropriate class and subclasses of the prior art was conducted at the U.S. Patent Office and revealed the following prior art patents.

| | | | |
|---|---|---|---|
| 1,045,311 | 2,313,776 | 3,037,718 | 3,392,928 |
| 2,171,648 | 2,522,109 | 3,239,158 | 3,633,838 |
| 2,253,664 | 2,889,122 | 3,362,653 | 4,383,656 |

A review of the above cited art discloses a variety of attachments or roll holder modifications to solve the above noted problem. However, a close review reveals that in some instances, the flanges are an integral component of the roll, thus requiring a specially designed roll holder to satisfy the problem. In other instances, extension elements are provided to release the roll holder which results in projecting elements that may interfere with a person's body or clothing when in use. None of the art found discloses a plastic disc which simply fits over the reduced diameter portion of the roll holder and has an outer diameter that extends beyond the roll holder mechanism to allow easy placement of two fingers on its outer surface to apply a compressive force and release the roll holder from its mounting.

SUMMARY OF THE INVENTION

The instant invention relates to a quick release attachment that includes a plastic disc having a central bore approximating the outer diameter of an end of a conventional tissue roll holder found in many homes and an outer diameter that extends beyond the ear of the mounting frame that supports the roll holder to facilitate engagement with one's fingers to release the roll holder from its mounting frame. The novel release disc is made of plastic material and is easily installed to completely solve a problem which has existed for an extended period of time.

OBJECTS OF THE INVENTION

An object of the invention is to provide an inexpensive attachment for releasing a tissue roll holder from its mounting.

Another object of the invention is to provide a releasing disc that is made of a friction reducing plastic material that will not interfere with the normal tissue dispensing.

A further object of the invention is to provide an attachment that does not require a specialized roll holder or any modification to the conventional tissue roll holder.

Yet another object of the invention is to provide a releasing disc that is easily installed without the need for any tools.

Still another object of the invention is to provide a releasing disc that is readily useable by persons of poor dexterity, ill health or other physical infirmities without any difficulties.

These and other objects of the invention will become more apparent hereinafter. The invention will nw be described with particular reference to the accompanying drawings which form a part of this specification wherein like reference characters designate the corresponding parts in the several views.

DETAILED DESCRIPTION OF THE DRAWINGS

Figure 1:
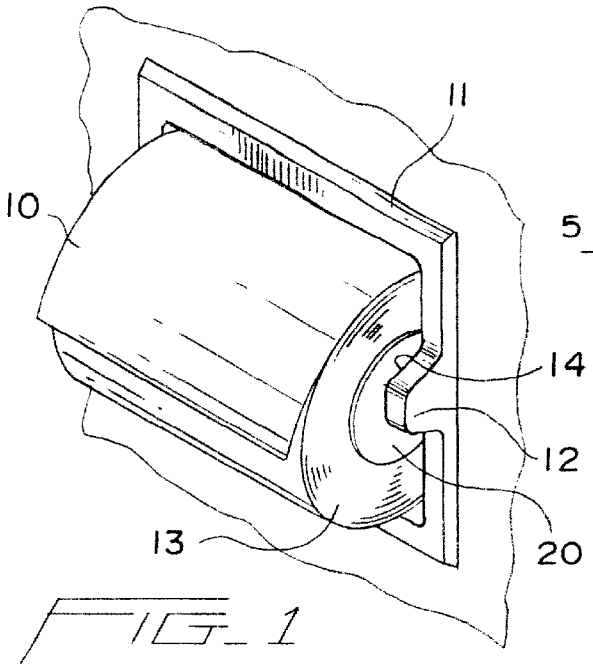
FIG. 1 is a perspective view illustrating a roll of issue mounted on its roll holder with the release disc mounted in place in a wall mounting frame.

Referring now to FIG. 1, there is shown a perspective view of a tissue roll 10 mounted on a roll holder 30 (not visible here) that is positioned in a conventional mounting frame 11 having a pair of ears 12 projecting therefrom for supporting the roll holder therein. The novel roll release disc 20 is shown mounted on roll holder 30 and is located between the tissue roll side face 13 and the inner face 14 of projecting ear 12. This view is an illustration of how release disc 20 cooperates with roll holder 30 when it is mounted thereon. As can be seen from this view, everything shown is conventional and is what is normally found in the usual mounting of a tissue roll 10 in its mounting frame 11 with the inclusion of release disc 20 mounted in place. As shown, there has not been any physical changes required to accept release disc 20.

Figure 2:
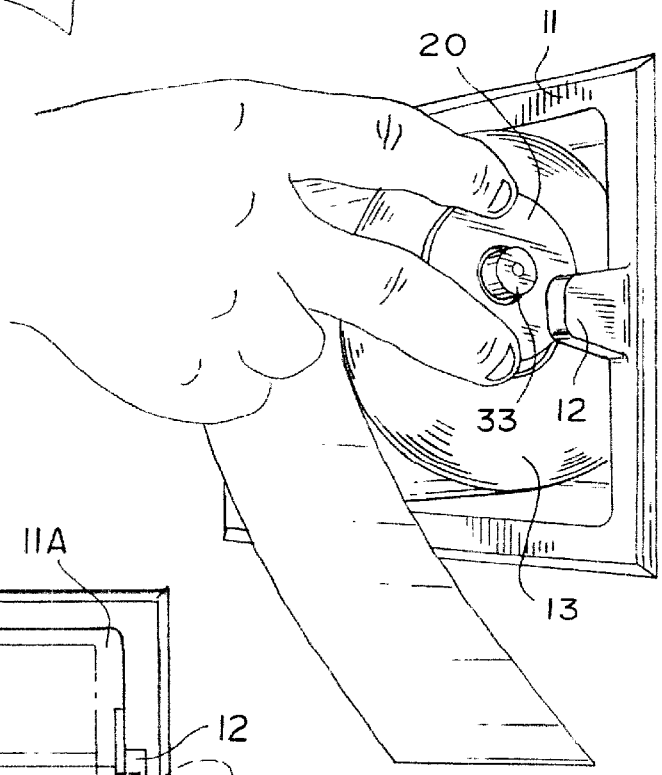
FIG. 2 is another perspective view illustrating the manner of compressing the issue roll holder for insertion into its mounting frame.
Figure 3:
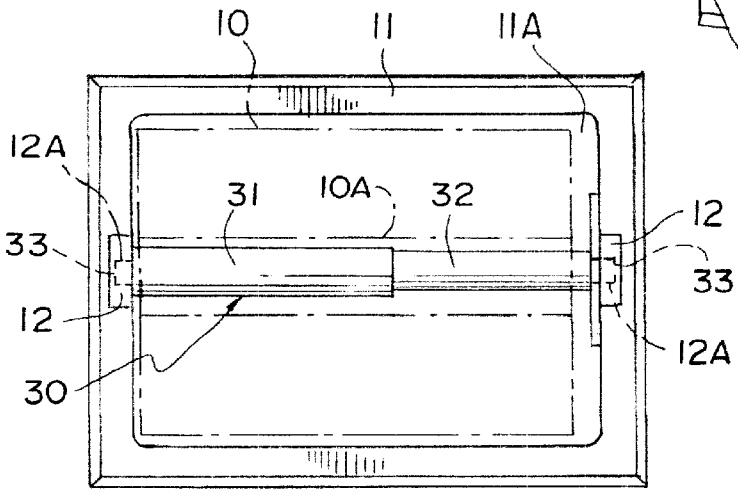
FIG. 3 is a frontal view of the roll holder in its mounting frame with the novel release disc in place. A roll of tissue is shown in phantom lines to show its relationship to the roll holder and its mounting frame.

FIG. 2 is a perspective view illustrating the manner in which a fresh roll of issue 10 is placed on tissue roll holder 30 with release disc 20 placed over the reduced diameter portion 33 in preparation for the insertion into the bore 12A of projecting ear 12. As shown, an index and middle finger is placed against the outer surface of release disc 20 and an inward force is applied thereto which will force inner cylindrical portion 32 into outer cylindrical portion 31 of roll holder 30 and compress the coil spring (not shown) within second cylindrical portion 31 to permit reduced diameter portion 31 to clear projecting ear 12 and move into alignment with bore 12A and a release of pressure will allow reduced diameter portion 33 to enter bore 12A for completion of the fresh tissue roll insertion procedure.

The above procedure describes the insertion of the fresh tissue roll process. The removal of the roll holder 30 when the tissue roll 10 has been depleted is basically the reverse of the process outlined above, however, it is also the more vexing procedure when dealing with roll holders 30 that are not equipped with the novel release disc 20. As we are all aware, when the tissue roll 10 has been used up, there remains the usual paper core which overlays the roll holder 30 and obscures a major portion of, if not all, of roll holder 30. The removal process is further complicated by the fact that both cylindrical portions 31 and 32 are biased in opposite directions against the inside face 12A of projecting ears 12 thus making the release of roll holder 30 a challenging experience, especially so, as pointed out above, for persons of reduced dexterity or other infirmities. However, this problem is totally resolved with the use of applicant's release disc 20. With applicant's device installed, one only needs to reverse the procedure described with reference to FIG. 1 and apply leftward pressure to the outer face of release disc 20 and compress the spring (not shown) thus releasing reduced diameter portion 33 and allowing its removal.

Figure 4:
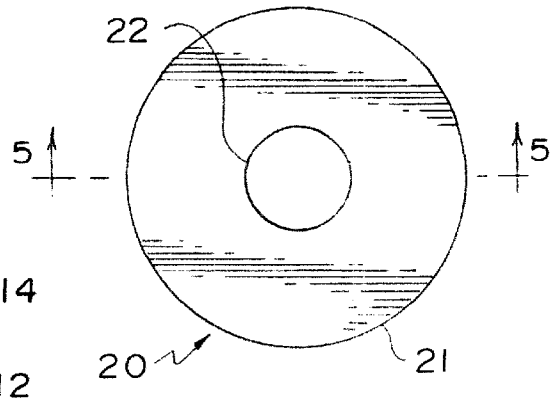
FIG. 4 is a plan view of the release disc per se.

Turning now to FIG. 4, there is shown a plan view of release disc 20 per se. As shown, release disc 20 has an inner diameter 22 that is slightly larger than the outer diameter of the reduced diameter end portion 33 of roll holder 30. Further, it has an outer diameter 21 that is large enough to extend beyond the dimensions of projecting ear 12 to allow finger access when it is time to install a fresh tissue roll 10 thereon. The preferred material for the release disc 20 is plastic such as nylon due to its friction reducing characteristics. Such a disc will reduce any friction generated between the end face 13 of tissue roll 10 and the inner face 14 of projecting ear 12 when the free end of tissue roll 10 is pulled to remove some tissue during use.

Figure 5:
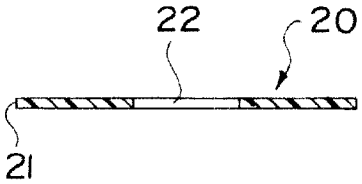
FIG. 5 is a cross-sectional view taken along the plane 5—5 of FIG. 4, illustrating its thickness.

FIG. 5 is a cross-sectional view of release disc 20 illustrating its approximate dimensions. As shown, it is provided with a central bore 22 which is slightly larger than the outer diameter of reduced diameter portion 33 of roll holder 30. As pointed out above, outer diameter 21 of release disc 20 is sufficiently large to extend beyond the profile of projecting ears 12 to allow easy finger access.

By way of review, it is pointed out that applicant's release disc 20 is adaptable to roll holders of various types whether they are made of plastic, wood or metallic. The only requirement is that the reduced diameter portion 33 of the roll holder 30 conforms to the central bore 22 and allows release disc 20 to be placed thereover. Further, it is pointed out that although mounting frame is shown recessed into the wall with a pair of projecting ears 12, the subject invention is useable with other style supports for the roll holder also. Additionally, release disc 20 is shown mounted to the right of roll holder 20, however, it is equally effective when mounted to the left of tissue roll holder 30.

While the invention has been described in its preferred embodiment, it is to be understood that the words which have been used are words of description rather than words of limitation and that changes may be made within the purview of the appended claims without departing from the full scope or spirit of the invention.

Having thus described my invention, I claim:

1. A tissue roll holder in combination with supporting means and attachment means for releasing the roll holder from the supporting means comprising:

supporting means including a frame portion and a concave portion for receiving a portion of a tissue roll therein;

said supporting means further including a pair of projecting ear means extending from a front face of said frame portion;

a tissue roll holder having a pair of reduced diameter ends forming a shoulder thereon and operably mounted in said supporting means, and attachment means operably positioned on one of said reduced diameter portions between said shoulder of said roll holder and said projecting ear means;

said attachment means comprises a disc member having a central bore therein conforming to said reduced diameter of said roll holder and an outer diameter extending radially beyond said ear means to provide an engagement surface for one's fingers to release said roll holder from said projecting ear means;

whereby upon applying pressure to said disc member, said tissue roll holder is quickly released from said supporting means in preparation for the installation of a fresh roll of tissue thereon.

2. The combination as described in claim 1 wherein said roll holder includes a pair of telescopic members of different diameter and biasing means for urging said telescopic members in opposite directions to hold said roll holder in said supporting means.

3. The combination as described in claim 2 wherein said pair of projecting ear means includes inward facing recesses for receiving said reduced diameter ends of said roll holder and provide support thereto.

4. An attachment for use with a tissue roll holder when mounted in its supporting frame, said attachment comprising:

a release disc for releasing a tissue roll holder from a supporting frame upon depletion of the tissue therefrom;

said release disc comprising a central bore to allow positioning of said release disc over a reduced diameter portion of said roll holder and an outer diameter extending beyond the supporting frame in abutting relation with the roll holder and the projection of said supporting frame whereby placement of two fingers against the outer surface of said release disc in straddling relation to the projections of the support frame and applying an inward force allows the roll holder to be compressed and readily released from the projections of the support frame when a tissue roll needs replacement.

5. An attachement for use with a tissue roll holder as described in claim 4 wherein said disc member is made of friction reducing material to allow easy dispensing of tissue from a tissue roll when mounted on the roll holder.

6. An attachment for useholder as described in claim 5 wherein said friction reducing material is nylon.

7. An attachment for use with a tissue roll holder as described in claim 5 wherein said friction reducing material is teflon.

8. An attachment for use with a tissue roll holder as described in claim 5 wherein said friction reducing material is any suitable plastic.

* * * * *